US009147356B1

(12) United States Patent
Moomaw

(10) Patent No.: US 9,147,356 B1
(45) Date of Patent: Sep. 29, 2015

(54) APPARATUS FOR AFFECTING MOTION IN AN INFLATABLE DISPLAY

(71) Applicant: David E. Moomaw, East Aurora, NY (US)

(72) Inventor: David E. Moomaw, East Aurora, NY (US)

( * ) Notice: Subject to any disclaimer, the term of this patent is extended or adjusted under 35 U.S.C. 154(b) by 0 days.

(21) Appl. No.: 14/330,781

(22) Filed: Jul. 14, 2014

Related U.S. Application Data

(60) Provisional application No. 61/957,913, filed on Jul. 14, 2013.

(51) Int. Cl.
*G09F 19/00* (2006.01)
*G09F 19/02* (2006.01)
*F04B 43/113* (2006.01)

(52) U.S. Cl.
CPC ..... *G09F 19/02* (2013.01); *F04B 43/113* (2013.01)

(58) Field of Classification Search
CPC ..... G09F 19/02
USPC ..... 40/412; 446/221
See application file for complete search history.

(56) References Cited

U.S. PATENT DOCUMENTS

| | | | | |
|---|---|---|---|---|
| 6,447,361 | B1 * | 9/2002 | Akiyama | 446/226 |
| 7,311,580 | B2 | 12/2007 | Moomaw | |
| 7,614,171 | B2 * | 11/2009 | Hsu | 40/412 |
| 7,758,400 | B2 | 7/2010 | Moomaw | |
| 2012/0103449 | A1 * | 5/2012 | Jung et al. | 137/625.48 |

* cited by examiner

*Primary Examiner* — Kristina Junge
(74) *Attorney, Agent, or Firm* — Simpson & Simpson, PLLC

(57) ABSTRACT

A valve apparatus for an inflatable article, wherein the inflatable article includes a main body and a moveable portion. The valve includes a valve body and a baffle. The valve body includes first and second chambers and first, second and third openings. The baffle is moveable between first and second positions. The first chamber includes the first and second openings, while the first opening forms a first fluid communication between the main body and the first chamber. The second chamber includes the second and third openings, while the third opening forms a second fluid communication between the second chamber and an ambient atmosphere. When in the first position, the baffle seals the first opening and when in the second position, the baffle seals the third opening.

17 Claims, 10 Drawing Sheets

APPARATUS FOR AFFECTING MOTION IN AN INFLATABLE DISPLAY

CROSS-REFERENCE TO RELATED APPLICATIONS

This patent application claims the benefit under 35 U.S.C. §119(e) of U.S. Provisional Patent Application No. 61/957,913, filed Jul. 14, 2013, which application is incorporated herein by reference.

FIELD OF THE INVENTION

The invention broadly relates to inflatable displays, more specifically to inflatable displays including moving elements, and even more particularly to an inflatable display including moving elements and a single inflation device.

BACKGROUND OF THE INVENTION

In the field of inflatable displays, animation is desirable to add movement and interest to the display. Heretofore, movement has been limited to only a few mechanisms. For example, U.S. Pat. Nos. 7,311,580 and 7,758,400 disclose imparting a spinning motion within an inflatable device, such as the spinning of flakes within a globe, by using an air jet stream essentially leaked out of the internal air pressure within the inflatable device. Another known example of movement includes using an electric motor device, separate from the inflation motor, to physically move or shake the inflated article. Yet another example of movement includes using an electric motor to open and close a valve allowing the internal pressure within the inflated article to inflate/deflate a bellows. In these devices, the inflated bellows affects the desired movement.

Although animated displays are quite prevalent in the marketplace, the current designs may be expensive, complex and prone to failure due to the added circuits, electric motors, etc. As can be derived from the variety of devices and methods directed to inflatable display animation, many means have been contemplated to accomplish the desired end, i.e., visually pleasing, lifelike inflatable displays. Heretofore, tradeoffs between cost, complexity and performance were required. Thus, there is a long-felt need for an efficient apparatus for both the inflation of an inflatable display, as well as animated movement of the same.

BRIEF SUMMARY OF THE INVENTION

The present apparatus provides desirable animation for inflatable displays while requiring no additional motors to function. The present design greatly limits air loss, and the small size and simplicity of the present device provides considerable improvements in design flexibility, e.g., use for rotational, linear and pivotal movement, as discussed in greater detail infra.

The present invention broadly comprises a valve apparatus for an inflatable article, wherein the inflatable article includes a main body and a moveable portion. The valve includes a valve body and a baffle. The valve body includes first and second chambers and first, second and third openings, and the baffle is moveable between first and second positions. The first chamber includes the first and second openings and the first opening forms a first fluid communication between the main body and the first chamber. The second chamber includes the second and third openings and the third opening forms a second fluid communication between the second chamber and an ambient atmosphere. When the baffle is in the first position, the baffle seals the first opening, and when the baffle is in the second position, the baffle seals the third opening.

In some embodiments, the baffle includes a shaft having a first end and a second end opposite the first end, a first valve plate arranged adjacent to the first end and a second valve plate arranged adjacent to the second end. In some embodiments, the baffle further includes a first secured plate fixedly secured to the shaft between the first end and the first valve plate and a second secured plate fixedly secured to the shaft between the second end and the second valve plate, the first secured plate includes a first slot, the second secured plate includes a second slot, the first valve plate includes a first extension positioned within the first slot and the second valve plate includes a second extension positioned within the second slot.

In some embodiment, the valve apparatus further includes a bellows secured to the valve body and in fluid communication with the second opening, wherein when the baffle is in the first position the bellows collapses and when the baffle is in the second position the bellows expands. In some embodiments, a single fluid moving apparatus inflates the main body and the bellows. In some embodiments, the moveable portion is inflatable and in fluid communication with the main body.

In some embodiments, pivotal movement of the moveable portion actuates the baffle between first and second positions, while in some embodiments, linear movement of the moveable portion actuates the baffle between first and second positions, and in some embodiments, rotational movement of the moveable portion actuates the baffle between first and second positions.

The present invention also broadly comprises an inflatable article including a main body, a moveable portion and a valve. The valve includes a valve body and a baffle. The valve body includes first and second chambers and first, second and third openings, and the baffle is moveable between first and second positions. The first chamber includes the first and second openings and the first opening forms a first fluid communication between the main body and the first chamber. The second chamber includes the second and third openings and the third opening forms a second fluid communication between the second chamber and an ambient atmosphere. When the baffle is in the first position, the baffle seals the first opening, and when the baffle is in the second position, the baffle seals the third opening.

The present invention also broadly comprises a method of affecting animation in an inflatable article. The inflatable article includes a main body, a moveable portion and a valve including a valve body and a baffle. The valve body includes first and second chambers and first, second and third openings. The baffle is moveable between first and second positions. The first chamber includes the first and second openings, while the first opening forms a first fluid communication between the main body and the first chamber. The second chamber includes the second and third openings, while the third opening forms a second fluid communication between the second chamber and an ambient atmosphere. When in the first position, the baffle seals the first opening and when in the second position, the baffle seals the third opening. The method includes the steps of: a) providing a positive air pressure within the main body via at least one fluid moving apparatus; b) expanding a bladder arranged between the main body and the moveable portion via the positive air pressure and the first fluid communication from the main body, through the first chamber and to the bladder, wherein the bladder imparts a force on a moveable plate attached to the moveable portion; c) animating the moveable portion relative to the inflatable article via the force on the moveable plate; d) changing the position of the baffle from the second position to the first position via an operable connection formed between the moveable plate and the baffle; and, e) collapsing the bladder by exhausting the positive air pressure from the bladder, through the second chamber and to the ambient atmosphere via the second fluid communication.

It is a general object of the present invention to provide a cost effective means to inflate an article while simultaneously effecting animation of an article attached to the article.

It is another general object of the present invention to provide a common mechanism that may be used to impart rotational, pivotal and linear movement in an inflatable article.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Various embodiments of the present invention will now be described, by way of example, with reference to the accompanying drawings in which embodiments of the present invention are shown. The present invention broadly comprises an apparatus for imparting motion in an inflatable article, e.g., air muscle 50, and an inflatable article, e.g., inflatable snowman 52.

Figure 1:
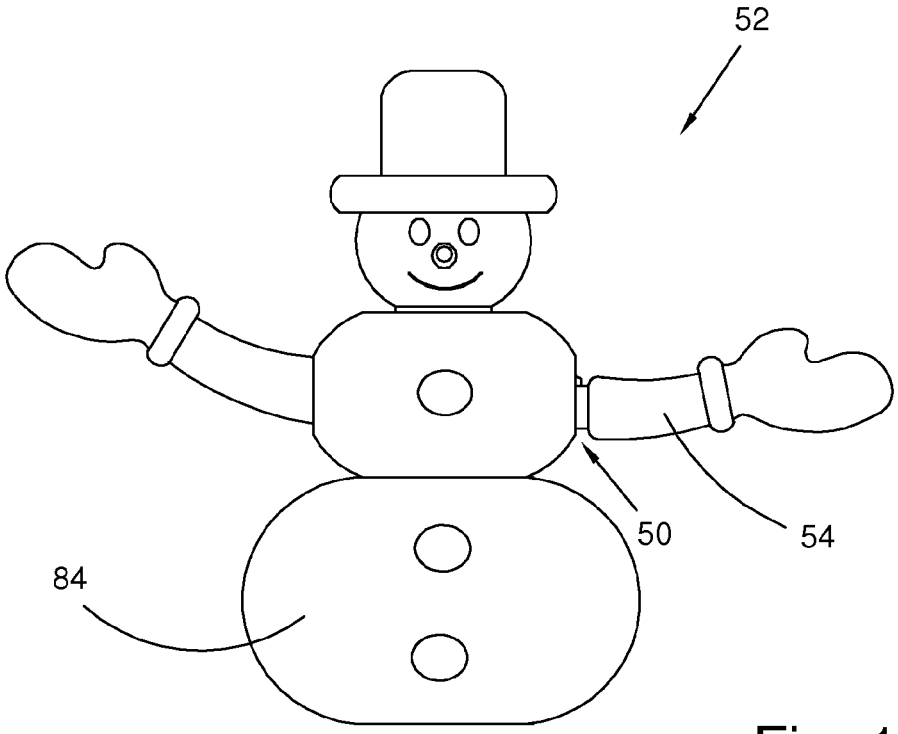
FIG. 1 is a front elevational view of an inflatable article having a present air muscle in a compressed state.

FIG. 1 is a front elevational view of a typical inflatable article, i.e., inflatable snowman 52, with an embodiment of an apparatus for affecting animation of the inflatable article, i.e., apparatus 50 in place, to provide rhythmic movement to a moveable portion, i.e., arm 54. In the view depicted in FIG. 1, bladder 56 is exhausted of air and in its collapsed state. This is also known as the first position of baffle 58, i.e., valve plate 60 of baffle 58 is sealed against opening 62 of chamber 64.

Figure 2:
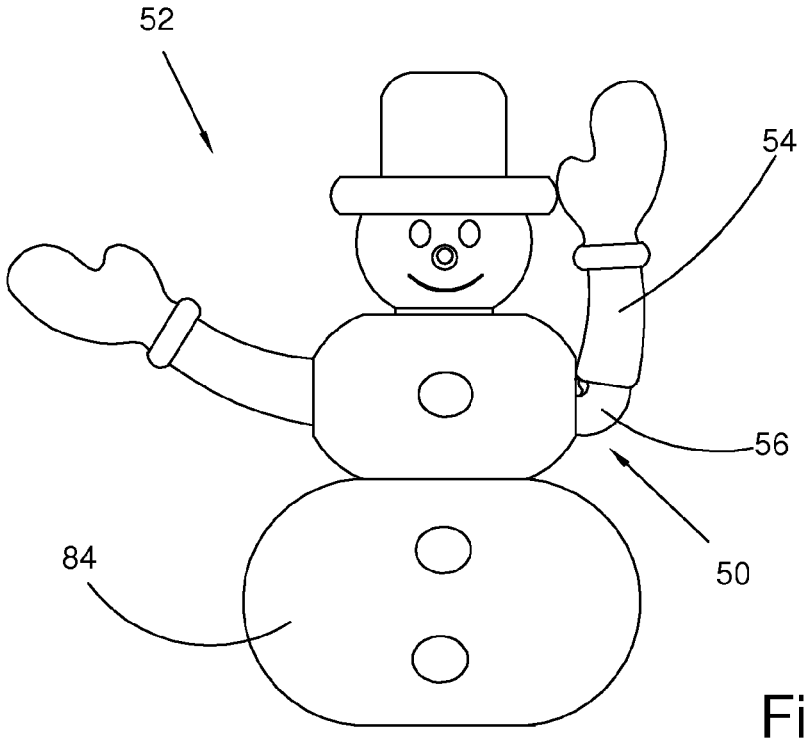
FIG. 2 is a front elevational view of the inflatable article of FIG. 1 having a present air muscle in an expanded state.

FIG. 2 is a front elevational view with inflatable article 52 having moveable portion 54 in a vertical arc or lifted position. In this position, bladder 56 is inflated with air to impart a lifting force to moveable portion 54. This is also known as the second position of baffle 58, i.e., valve plate 66 of baffle 58 is sealed against opening 68 of chamber 70.

Figure 3:
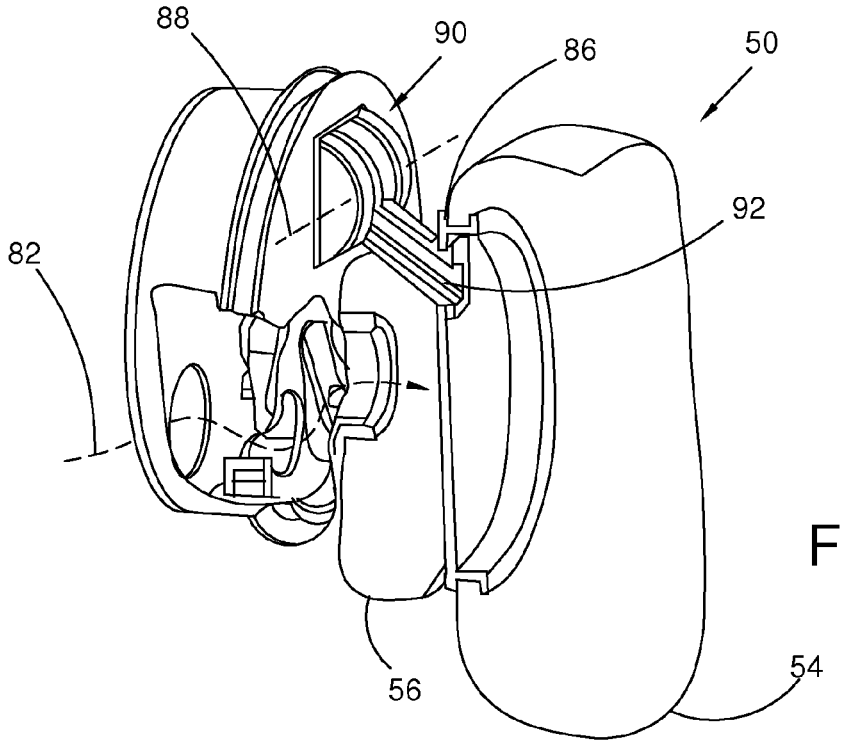
FIG. 3 is a cutaway perspective view of a present air muscle in a compressed state.

FIG. 3 is a cutaway view of an embodiment of air muscle 50 in the starting position at the start of an intake cycle, or alternatively at the final position at the end of an exhaust cycle. Exhaust valve 72 is closed while intake valve 74 is open, i.e., the second position of baffle 58. It should be appreciated that in the embodiments depicted in the figures, exhaust valve 72 comprises opening 68 and valve plate 66, while intake valve 74 comprises opening 62 and valve plate 60. Moreover, baffle 58 comprises valve plates 60 and 66, secured or securing plates 76 and 78, shaft 80. The nature and mode of operation of baffle 58 is described in greater detail infra. An air passage is created to allow air flow 82 from inside main body 84 of inflatable article 52 through intake hole 62 into bladder 56. As bladder 56 inflates, movement is imparted to plate 86 which causes moving element 54 to pivot about rotational axis 88 of plate hinge 90. It should be appreciated that in embodiments where the moveable element is also an inflatable element, air is permitted to flow from main body 84, through channel 92 and subsequently into moveable element 54. The foregoing arrangement provides a common air pressure within both main body 84 and moveable element 54.

Figure 4:
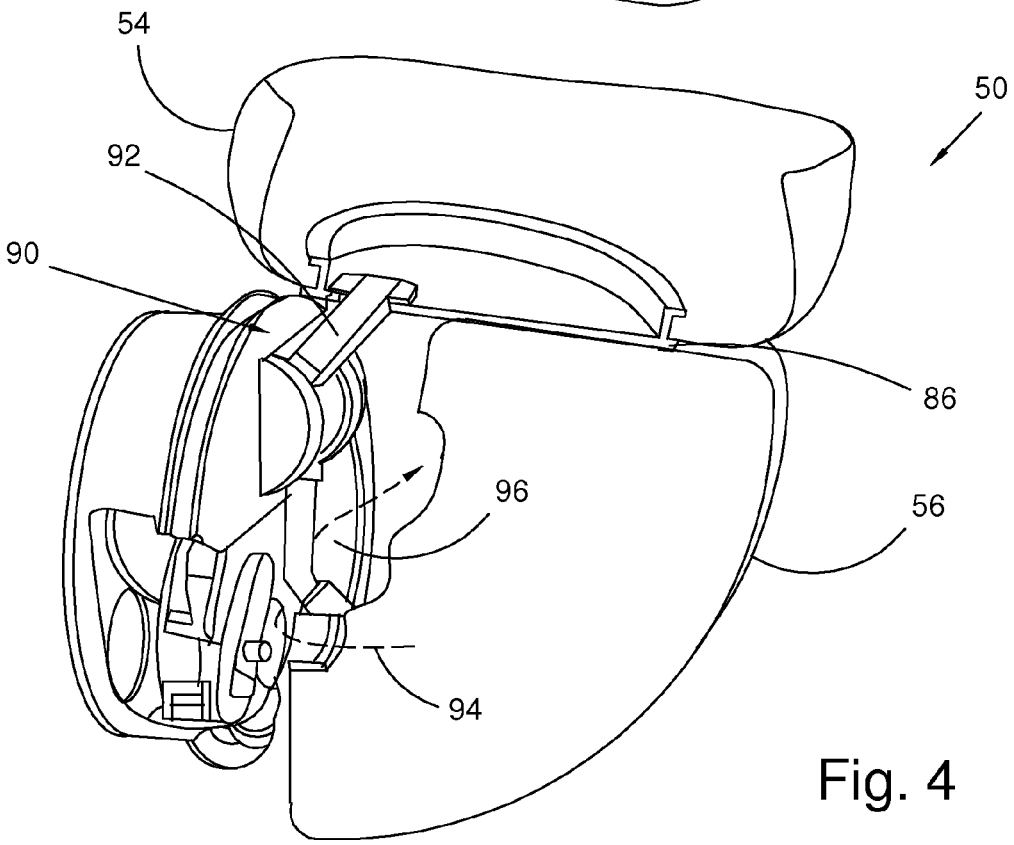
FIG. 4 is a cutaway perspective view of a present air muscle in an expanded state.

FIG. 4 shows the fully inflated position of bladder 56. In this position, intake valve plate 60 is covering and sealing intake opening 62 and exhaust valve plate 66 has moved to uncover or unseal exhaust opening 68. Air flow 94 depicts the deflation cycle whereby air pressure is exhausted to atmosphere from bladder 56, through exhaust opening 68 and lastly through exhaust port 96 to the atmosphere or ambient environment.

Intake valve plate 60 and exhaust valve plate 66 are both positioned to utilize air pressure to provide sealing force against intake opening 62 and exhaust opening 68, respectively. More specifically, air pressure in main body 84 seals valve plate 60 against intake opening 62, while air pressure in bladder 56 seals valve plate 66 against exhaust opening 68. The foregoing arrangement minimizes air leakage while requiring minimal activation force to open or close valves 72 and 74.

Figure 5:
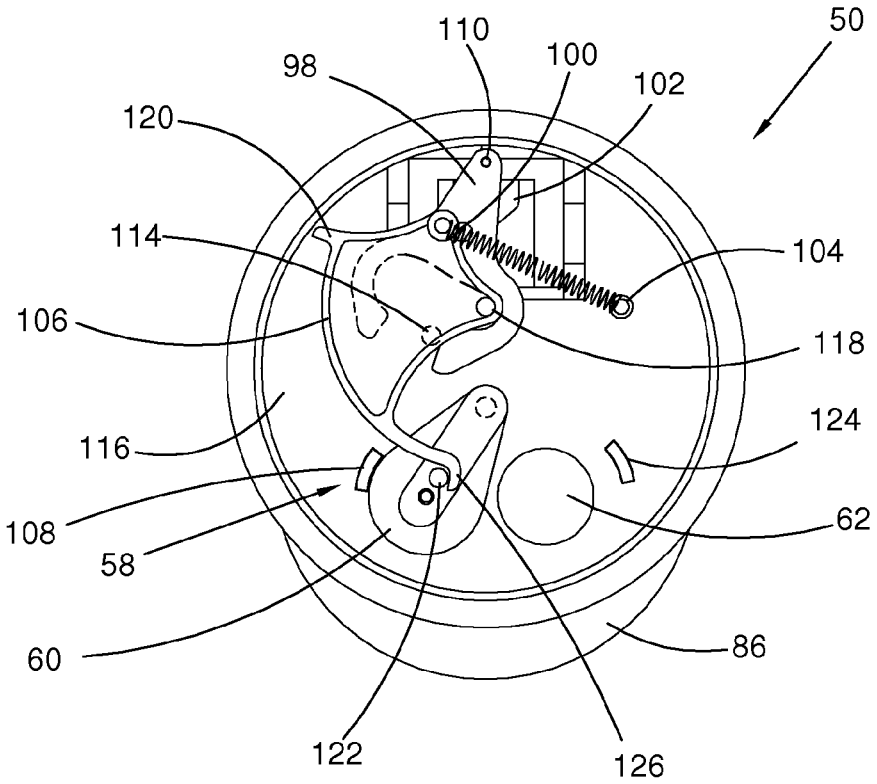
FIG. 5 is a back elevational view of a present air muscle in a fully compressed state having an open intake valve.

FIG. 5 details the first of five steps in an embodiment of a mechanical cycle for controlling air flow to and from bladder 56. Intake opening 62 is uncovered and plate arm 98 is in the start position. Plate arm 98 is maintained in position by the interaction of pin 100 within cam slot 102. The foregoing interaction and its associated movement are further described infra with respect to FIGS. 6 through 10. Spring 104 is in a shortened condition holding snap plate 106 at a start position. In the arrangement depicted in FIG. 5, further rotation of valve plate 60 in a clockwise direction is prevented by stop 108.

Figure 6:
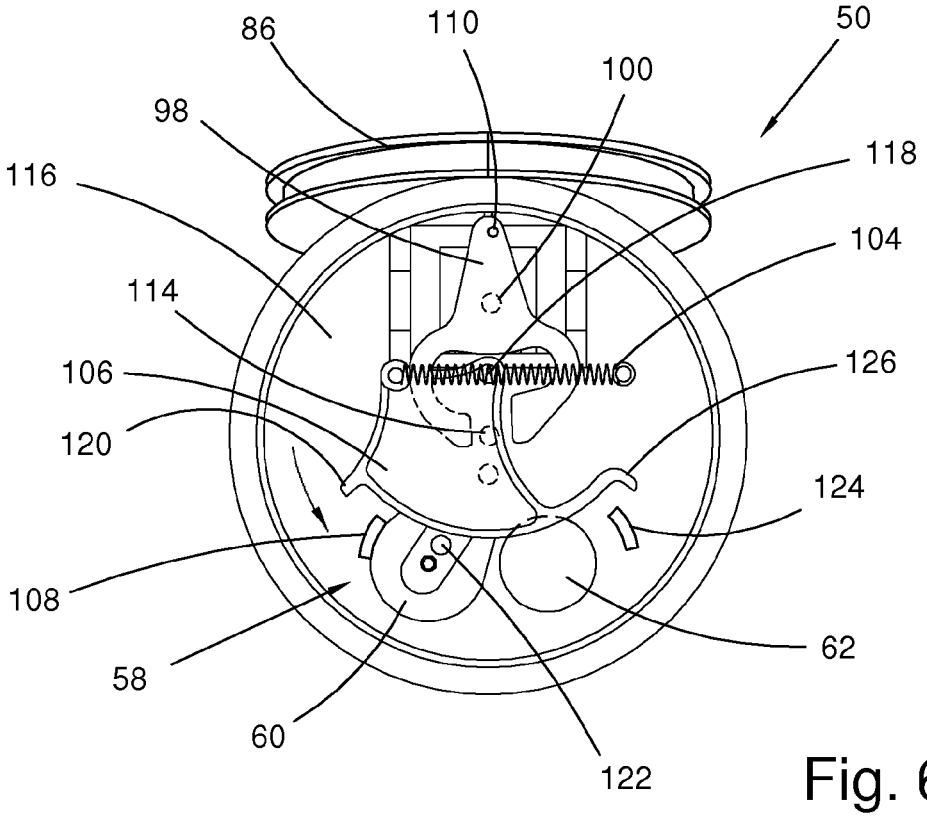
FIG. 6 is a back elevational view of a present air muscle in a partially expanded state having an open intake valve and rotating snap plate.

FIG. 6 details the second of five steps in an embodiment of a mechanical cycle for controlling air flow to and from bladder 56. Air flow 82 as shown in FIG. 3 expands bladder 56, rotating plate arm 98 counterclockwise through an arc provided by plate pivot axis 110. This angular displacement acts upon pin 100 affixed to plate arm 98 via a cam slot 102 formed in hinge 90. Plate arm 98 acts with pin 114 affixed to snap plate 106, rotating snap plate 106 counterclockwise. This rotation acts upon spring 104 via its connection to snap plate 106 at pin 106 and housing 116 at pin 118 causing it to extend and store energy. Spring 104 is shown at maximum extension.

Figure 7:
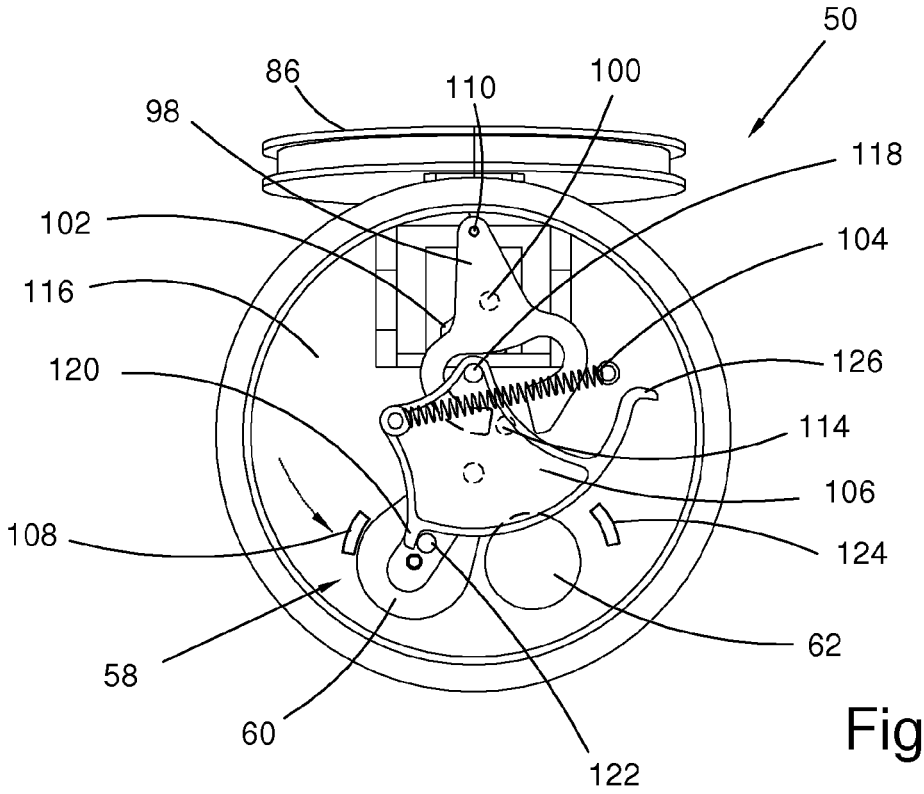
FIG. 7 is a back elevational view of a present air muscle in a fully expanded state having an open intake valve and a rotating snap plate moving past a transition point and contacting an intake valve plate.

FIG. 7 details the third of five steps in an embodiment of a mechanical cycle for controlling air flow to and from bladder 56. Plate 86 reaches the end of its travel, i.e., rotates about axis 88 to the position depicted in FIGS. 2 and 4. Spring 104 is past the rotational axis of snap plate 106, i.e., pivot point 118. Force supplied by extended spring 104 rotates snap plate 106 counterclockwise. Finger 120 on snap plate 106 contacts pin 122 affixed to valve plate 60.

Figure 8:
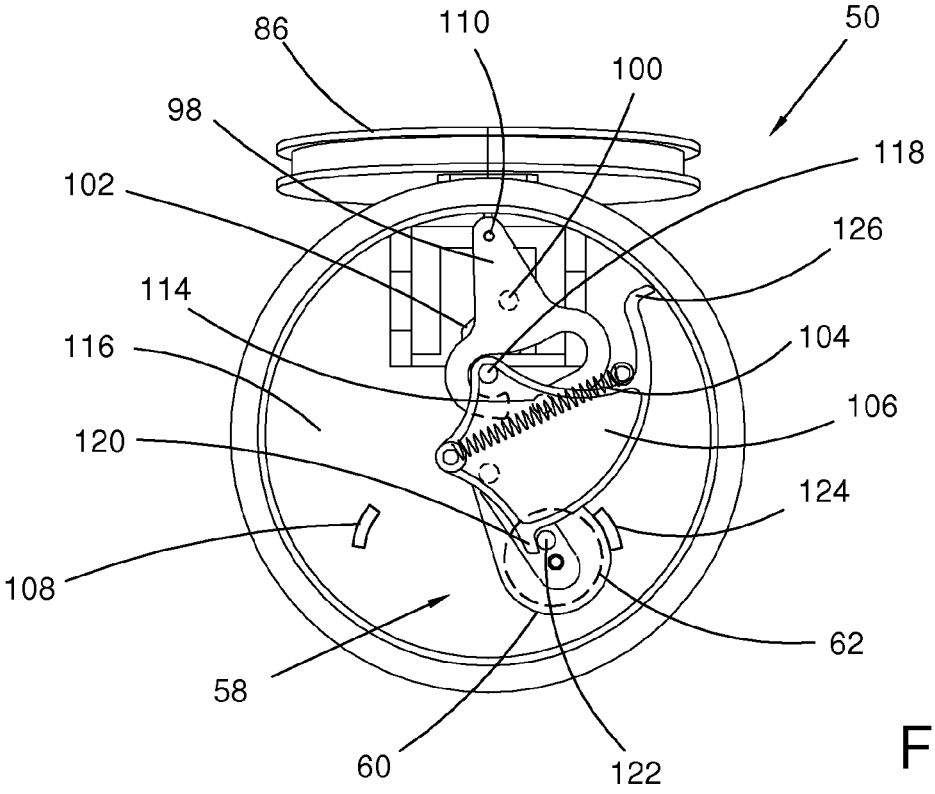
FIG. 8 is a back elevational view of a present air muscle in a fully expanded state having a closed intake valve.
Figure 11:
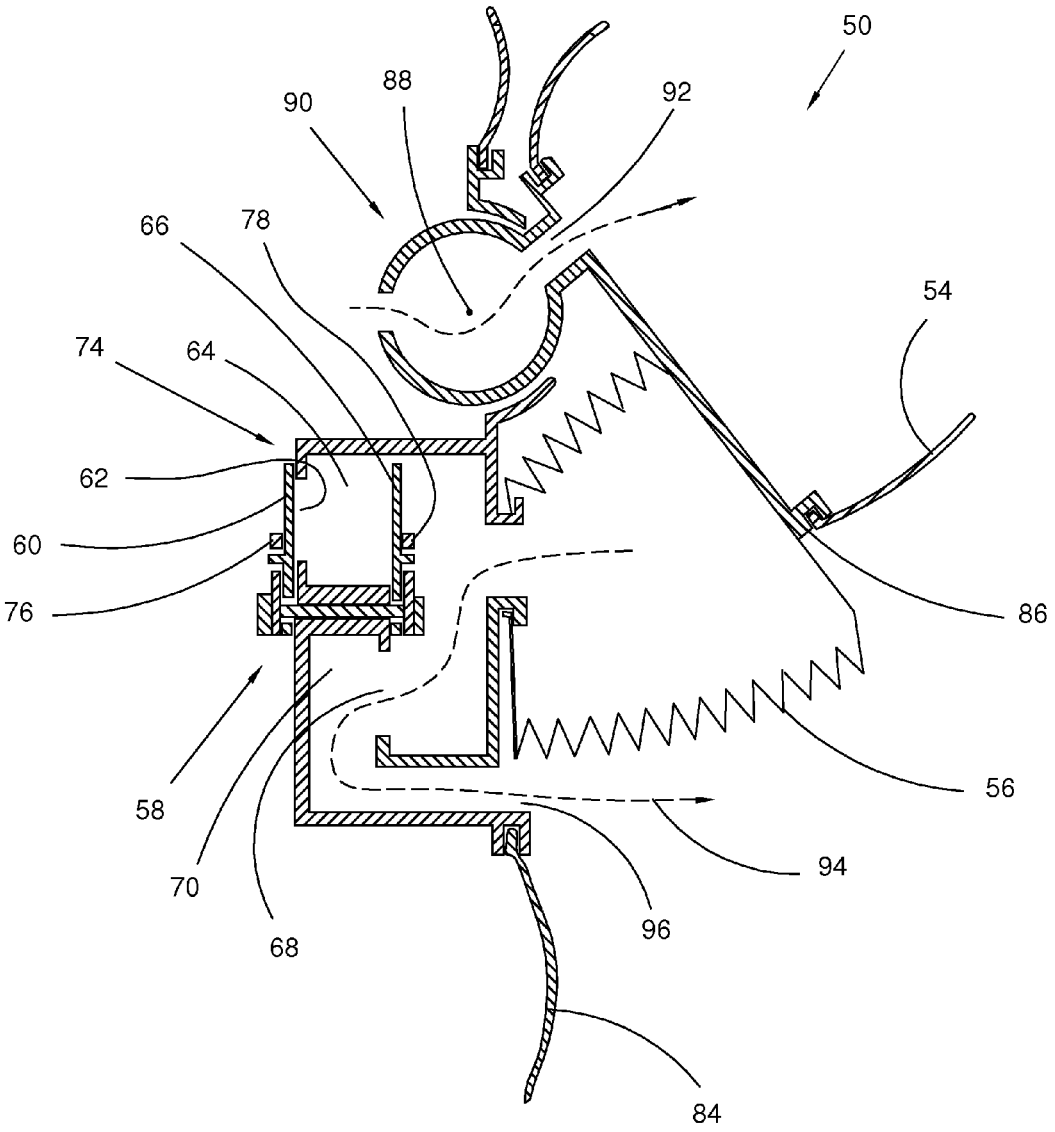
FIG. 11 is a cross-sectional view of an embodiment of a present air muscle in a partially expanded state and a baffle in a first position.

FIG. 8 details the fourth of five steps in an embodiment of a mechanical cycle for controlling air flow to and from bladder 56. Snap plate 106 finishes travel under influence of contracting spring 104, i.e., spring 104 contracts to its shortest length given the geometries of the apparatus, rotating valve plate 60 which in turn closes intake opening 62. The rotation of valve plate 60 is stopped by the interaction of valve plate 60 with stop 124. This simultaneously acts to rotate shaft 80 and thereby moves exhaust valve plate 66 to uncover exhaust opening 68 as shown in FIGS. 4 and 11.

The distance between fingers 120 and 126 provides a sufficient volume of fluid flowing into bladder 56 to move moveable element 54 upward prior to spring 104 taking over the rotational movement of snap plate 106. Progressing from FIG. 5 through FIG. 8, as snap plate 106 rotates about pivot 118, spring 104 is tensioned and moves past pivot 118. As spring 104 reaches approximately fifteen degrees beyond pivot 118 (See FIG. 7), spring 104 takes over the movement of snap plate 106 and causes finger 120 to engage pin 122 thereby rotating valve plate 60 over opening 62. Simultaneously, through the connection formed by shaft 80, valve plate 66 rotates thereby opening exhaust opening 68 and permitting air to flow therethrough. In short, the distance between fingers 120 and 126 provides sufficient fluid volume of air to fill bladder 56 and for air to be exhausted from bladder 56.

Figure 9:
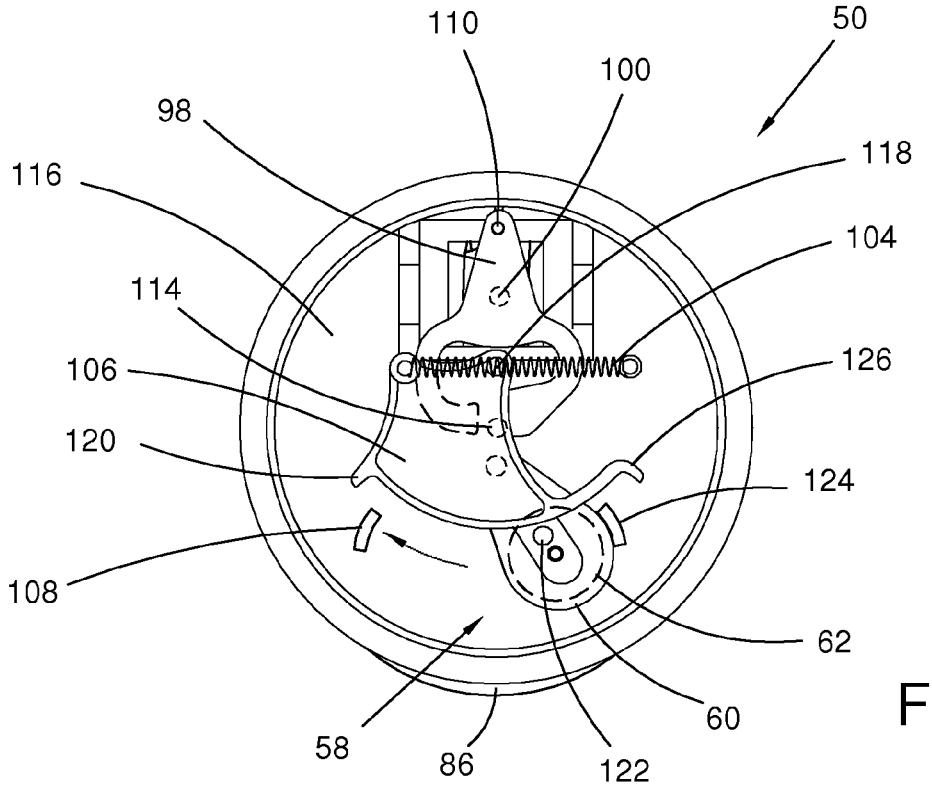
FIG. 9 is a back elevational view of a present air muscle in a partially compressed state having a closed intake valve and a snap plate at a transition point.

FIG. 9 details the fifth of five steps in an embodiment of a mechanical cycle for controlling air flow to and from bladder 56. As bladder 56 is exhausted via airflow 94 as shown in FIG. 4, plate hinge 90 rotates, acting upon pin 100 affixed to plate arm 98 thereby rotating arm 98 clockwise. Plate arm 98 acts upon pin 114 affixed to snap plate 106 rotating snap plate 106 clockwise and extending and loading spring 104.

Figure 10:
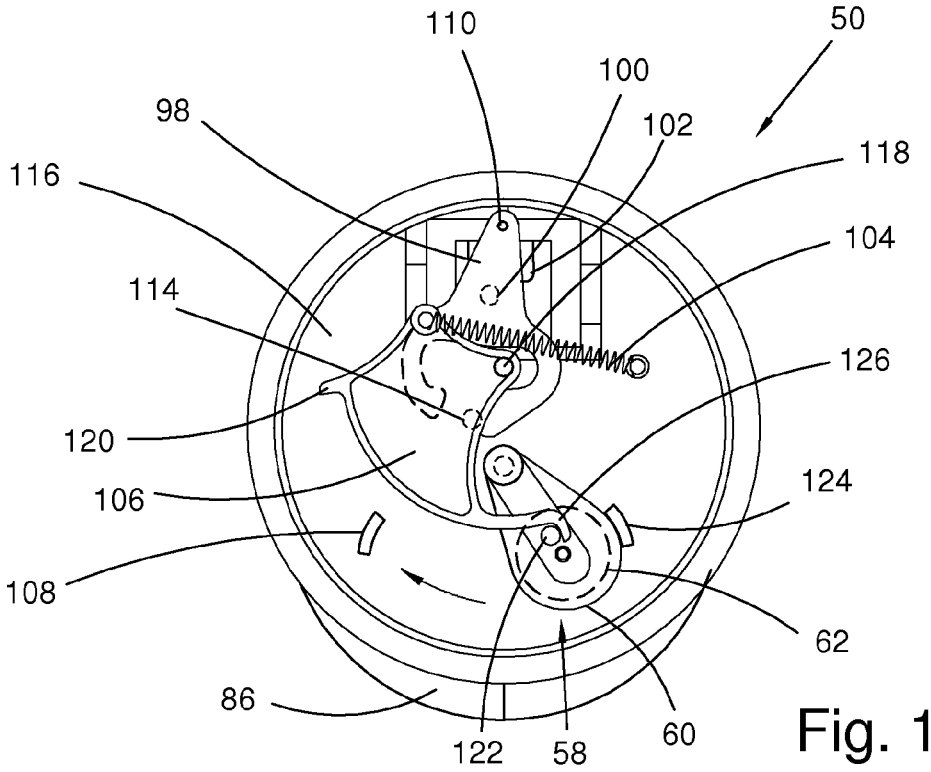
FIG. 10 is a back elevational view of a present air muscle in a fully compressed state having a closed intake valve and a rotating snap plate moving past a transition point and contacting an intake valve plate.

In FIG. 10, spring 104 is shown past the rotational axis of snap plate 106, i.e., pivot 118, which in turn acts upon snap plate 106 to continue clockwise rotation bringing finger 126 of snap plate 106 into contact with pin 122 affixed to valve plate 60. As snap plate 106 continues through its extent of travel, intake valve 74 is opened, and simultaneously exhaust valve 72 is closed thereby returning the mechanism to the start position depicted in FIG. 5.

Figure 12:
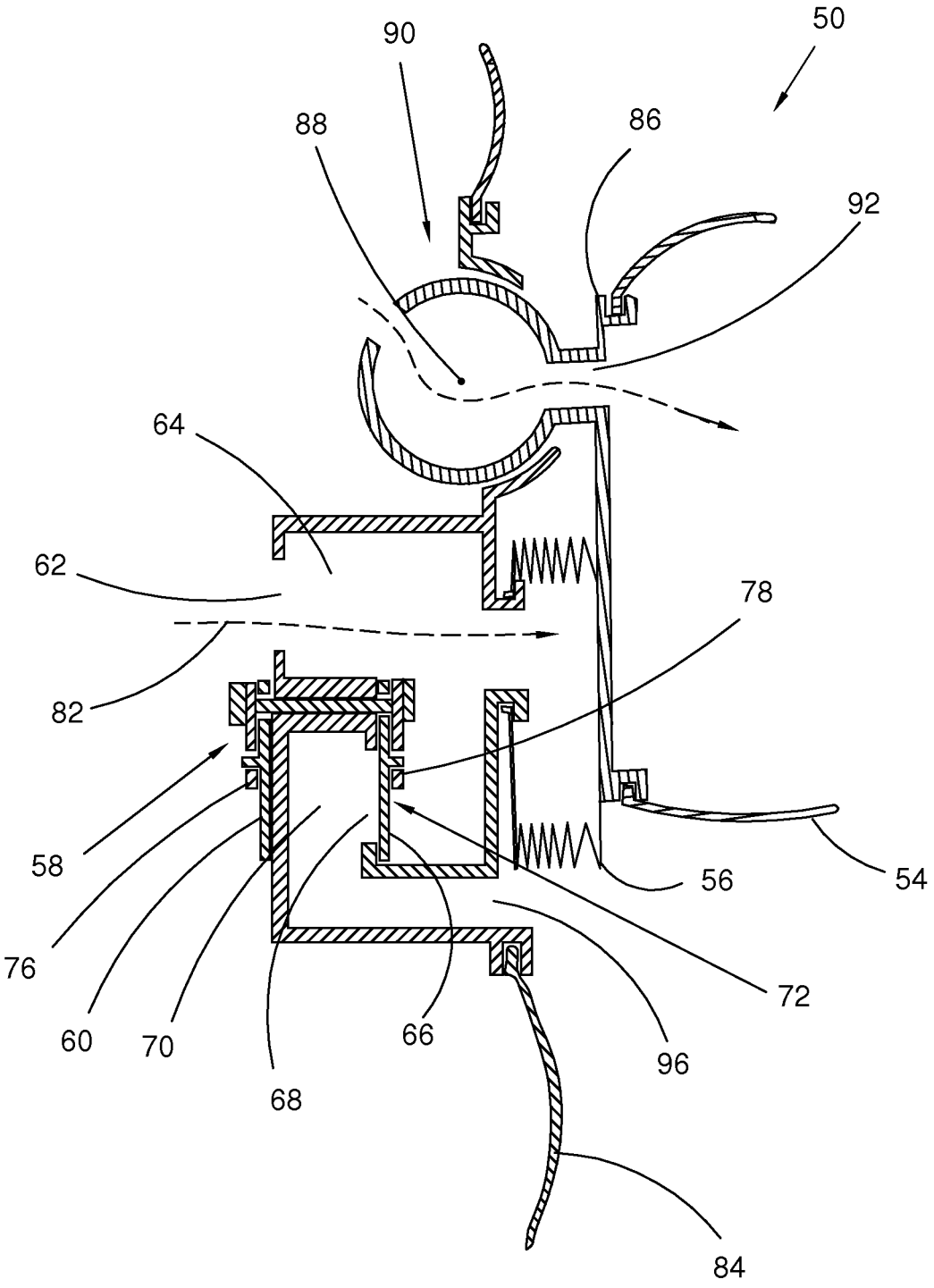
FIG. 12 is a cross-sectional view of an embodiment of a present air muscle in a compressed state and a baffle in a second position.

FIGS. 11 and 12 depict yet another embodiment of a present air muscle 50. In these embodiments, the flow paths of air for intake and exhaust are depicted, as well as the inflation of moveable portion 54 and baffle 58. The foregoing embodiments are illustrative of how air muscle 50 may be arranged to utilize a single fluid moving apparatus, such as a blower, fan, etc. Furthermore, it should be appreciated that the present invention may also use multiple blowers for instances where added fluid volume exchange is require, e.g., large inflatable articles and inflatable articles having more than one main body. Such variations fall within the spirit and scope of the claimed invention. Although not depicted in these embodiments, the nature and mode of operation of the movement of baffle 58 is substantially the same as set forth supra.

Figure 13:
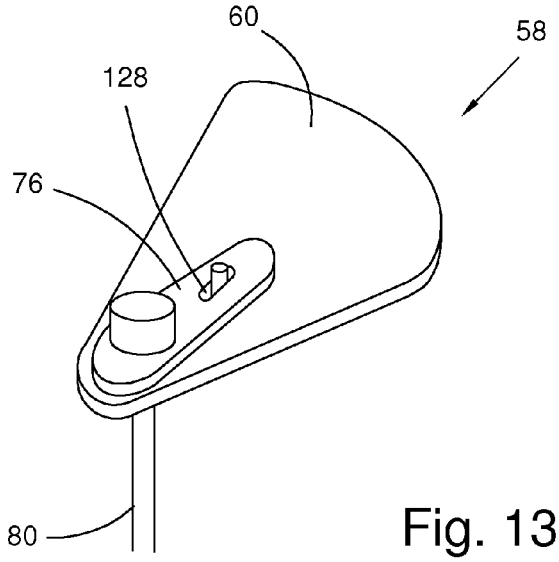
FIG. 13 is a perspective view of a portion of a baffle.
Figure 14:
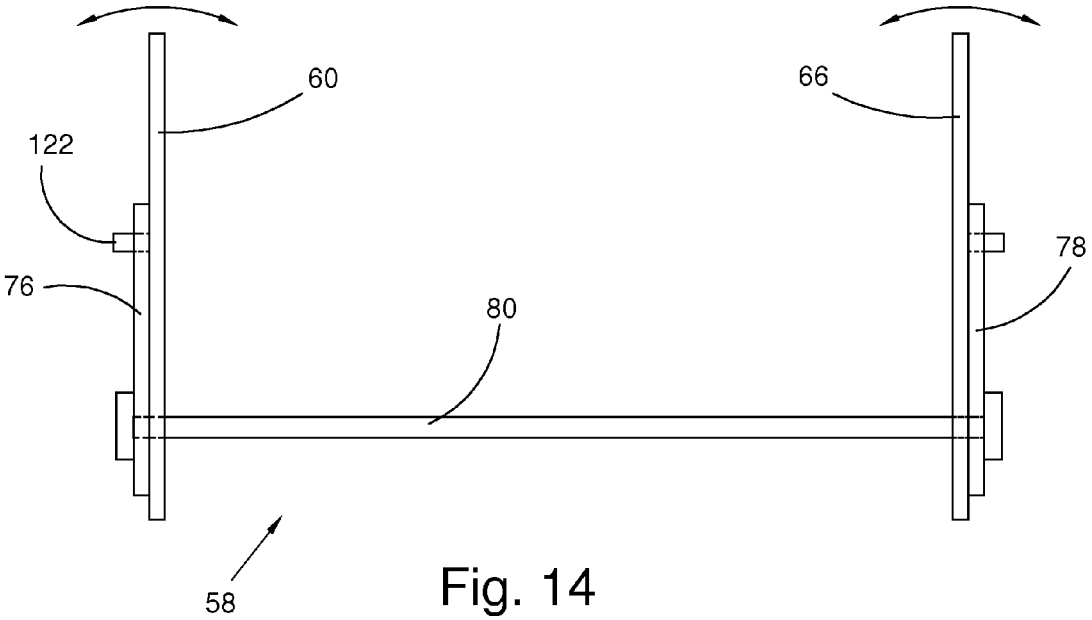
FIG. 14 is a side elevational view of a baffle.

The structure and arrangement of baffle 58 is best appreciated in view of FIGS. 13 and 14. Valve plates 60 and 66 are positioned on shaft 80; however, each plate is permitted to float on shaft 80, i.e., valve plates 60 and 66 are permitted to rotate and pivot slightly relative to shaft 80. Securing plates 76 and 78 each include a slot, e.g., slot 128, wherein extensions 130 and 132 are respectively positioned. Slots 128 permit slight movement of valve plates 60 and 66 relative to securing plates 76 and 78, i.e., slots 128 account for a slight amount of play between the valve plates and the securing plates. Securing plates 76 and 78 are fixedly secured to shaft 80. The foregoing arrangement permits plates 60 and 66 to free float relative to shaft 80 while fixing the rotation of plates 60 and 66 to the rotation of shaft 80. This arrangement provides improving sealing against openings 62 and 68 without regard to the manufacturing tolerances maintained during the forming of openings 62 and 68. In short, the arrangement of baffle 58 provides a consistent and sufficient seal throughout the use of present air muscle 50 as valve plates 60 and 66 are permitted to alter their respective positions to properly seat and seal against openings 62 and 68, respectively.

Figure 15:
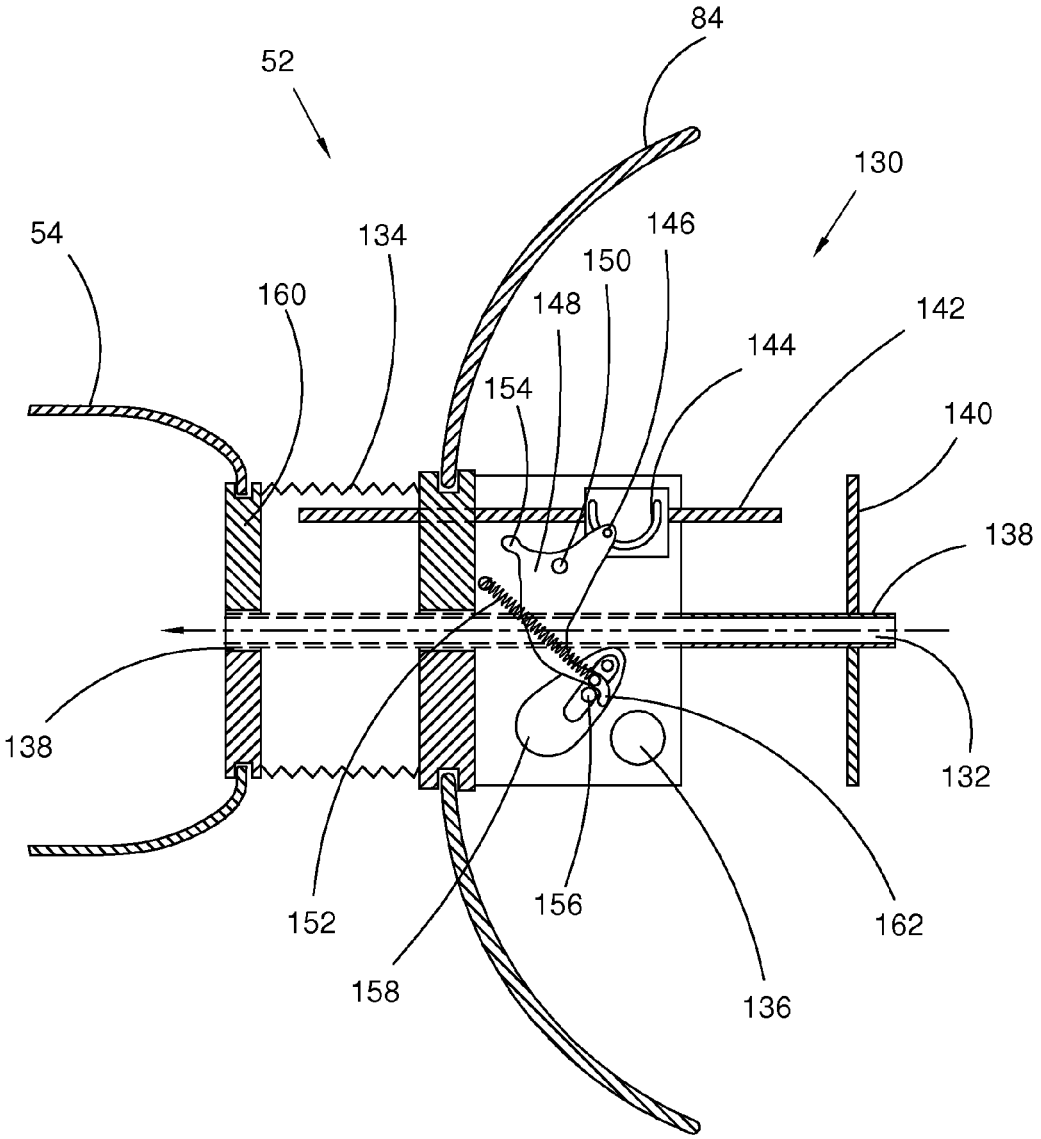
FIG. 15 is a cross-sectional view of an embodiment of a present air muscle arranged to impart linear motion.

FIG. 15 depicts air muscle 130 which is arranged to impart linear movement of moveable portion 54 relative to main body 84 of inflatable article 52. The nature and mode of operation of the valve mechanism is substantially similar to the above description of the present air muscle. However, some modifications were necessary to change the direction of movement from pivotal, FIGS. 1 through 12, to linear, FIG. 15. As described above, moveable portion 54 may be an inflatable article, and in those embodiments, air pressure is supplied from main body 84 through channel 132. When the valve mechanism is positioned such that air intake into bladder 134 occurs (the arrangement depicted in FIG. 15), air passes from main body 84 through opening 136 and subsequently into bladder 134. The expansion of bladder 134 causes tube 138 and thereby surface 140 to move toward air muscle 130 and in turn valve pin 142. As surface 140 contacts valve pin 142 and continues to move toward air muscle 130, pin 142 is moved and in turn cam surface 144, which is fixed secured to pin 142, also moves in the same direction. Cam surface 144 interacts with snap plate pin 146 thereby causing snap plate 148 to rotate about rotational axis 150. The foregoing driving force continues until such time as spring 152 passes rotational axis 150 by approximately fifteen degrees, in like fashion as described above. After spring 152 passes this position, spring 152 takes over the movement of snap plate 148 and causes finger 154 to interact with pin 156 of valve plate 158 thereby causing valve plate 158 to rotate to a position wherein opening 136 is sealed by valve plate 158. As described above, when opening 136 is sealed, an exhaust opening (not shown) is unsealed and air is permitted to exhaust from bladder 134. Gravity exerting on moveable portion 54 and/or a spring load causes plate 160 to move toward air muscle 130 which also moves tube 138 in the same direction as tube 138 is fixedly secured to plate 160. As plate 160 contacts pin 142 and bladder 134 continues to exhaust, pin 142 moves linearly and cam surface 144 interacts with snap plate pin 146 thereby causing rotation of snap plate 148. Again, once spring 152 reaches a position approximately fifteen degrees off of rotational axis 150, spring 152 takes over the rotation of snap plate 148. As snap plate 148 rotates, finger 162 interacts with valve pin 156 thereby causing valve plate 158 to rotate and unseal opening 136. As described above, the resulting position of valve plate 158 permits air to again flow into bladder 134 and the linear motion is repeated.

Figure 16:
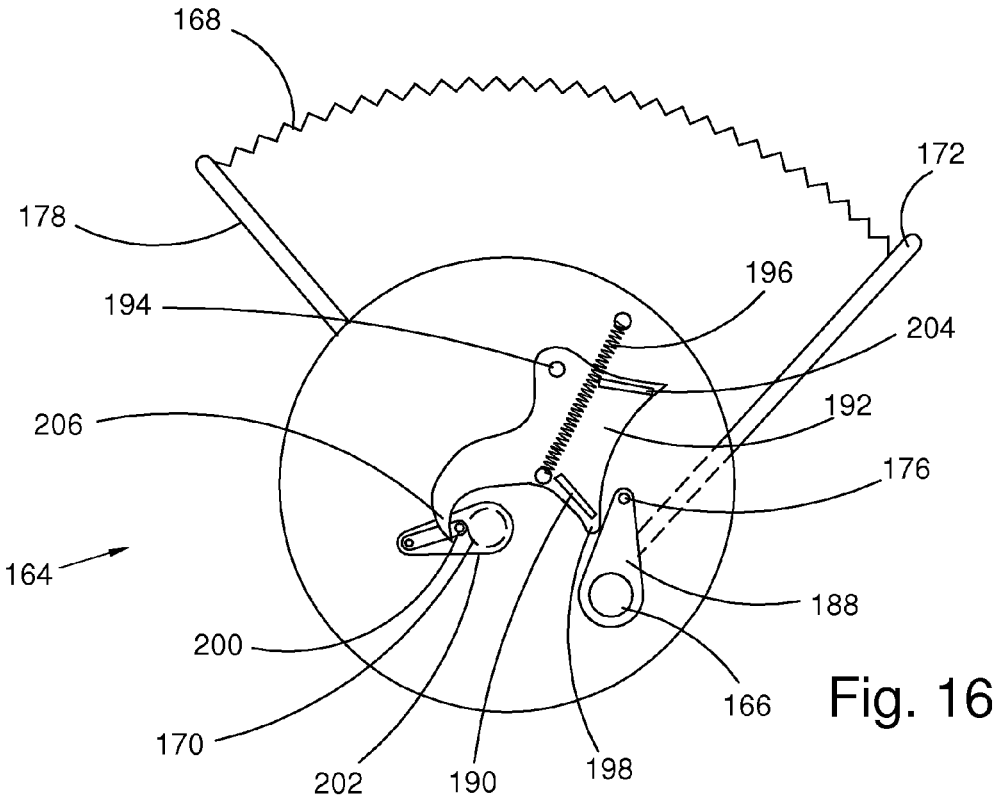
FIG. 16 is a bottom plan view of an embodiment of a present air muscle arranged to impart rotational movement; and, FIG. 17 is a top plan view of the air muscle of FIG. 16 showing a ratchet system arranged to impart rotational movement.
Figure 17:
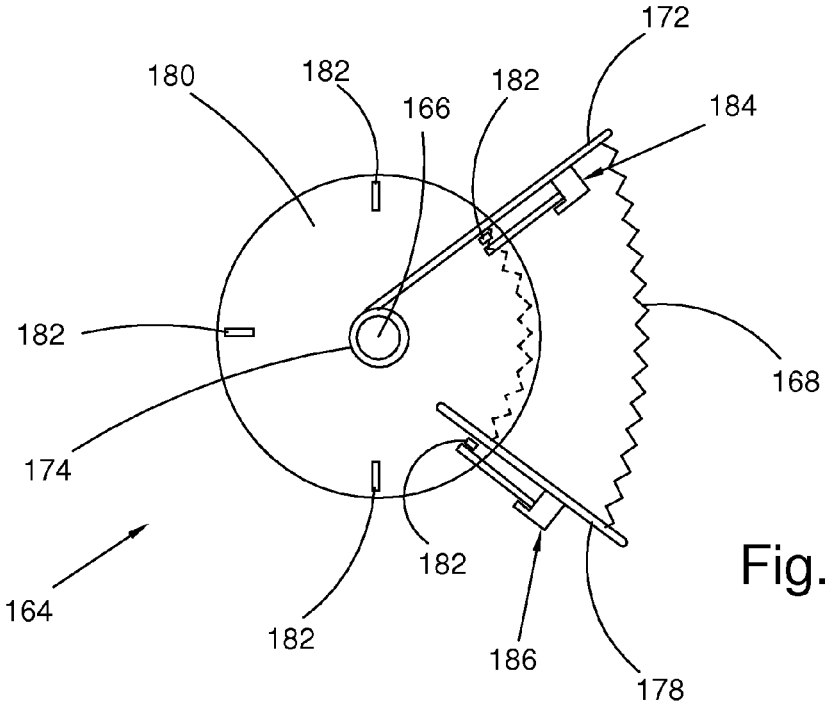

FIGS. 16 and 17 depict air muscle 164 which is arranged to impart rotational movement of moveable portion 54 relative to main body 84 of inflatable article 52. The nature and mode of operation of the valve mechanism is substantially similar to the above description of the present air muscle. However, some modifications were necessary to change the direction of movement from pivotal, FIGS. 1 through 12, to rotational, FIGS. 16 and 17. As described above, moveable portion 54 may be an inflatable article, and in those embodiments, air pressure is supplied from main body 84 through channel 166. When the valve mechanism is positioned such that air intake into bladder 168 occurs, air passes from main body 84 through opening 170 and subsequently into bladder 168. The expansion of bladder 168 causes moveable extension 172 and thereby tube 174 to rotate in a single direction and in turn actuator pin 176. Bladder 168 is positioned between extensions 172 and 178 and effects movement of the mechanism as described herein.

It should be appreciated that in the embodiments depicted in the figures, the rotation of moveable portion 54 and the driving of the valve mechanism is provided by a ratchet arrangement. Rotating plate 180 comprises ratchet stops 182 which interact with one or more pawls, e.g., pawls 184 and 186. In the embodiment depicted in FIG. 17, pawl 184 rotates away from pawl 186 during expansion of bladder 168. Pawl 186 interacts with one of ratchet stops 182 and prevents the opposite rotation of rotating plate 180 during exhausting of bladder 168, while pawl 184 is permitted to pass over ratchet stops 182 without hindering the exhausting of bladder 168.

As extension 172 rotates it causes similar rotation of plate arm 188. It should be appreciated that means of connecting extension 172 and plate arm 188 are not particularly germane to the invention and fall within the general knowledge of one having ordinary skill in the art. In short, any of a variety of means may be used to couple the angular displacement of extension 172 to the rotation of plate arm 188. Pin 176 of plate arm 188 contacts surface 190 of snap plate 192, which in turn causes snap plate 192 to rotate about rotational axis 194. The foregoing driving force continues until such time as spring 196 passes rotational axis 194 by approximately fifteen degrees, in like fashion as described above. After spring 196 passes this position, spring 196 takes over the movement of snap plate 192 and causes finger 198 to interact with pin 200 of valve plate 202 thereby causing valve plate 202 to rotate to a position wherein opening 170 is unsealed by valve plate 202. As described above, when opening 170 is unsealed, an exhaust opening (not shown) is sealed and air is permitted to fill bladder 168.

Gravity exerting on moveable portion 54 and/or a spring load causes rotating plate 180 and thereby extension 172 to move toward extension 178, and in like fashion plate arm 188 rotates opposite the previous direction. As pin 176 contacts surface 204 and bladder 168 continues to exhaust, snap plate 192 continues to rotate. Again, once spring 196 reaches a position approximately fifteen degrees off of rotational axis 194, spring 196 takes over the rotation of snap plate 192. As snap plate 192 continues to rotate, finger 206 interacts with valve pin 200 thereby causing valve plate 202 to rotate and seal opening 170. As described above, the resulting position of valve plate 202 permits air to again exhaust from bladder 168 and the rotational motion is repeated. It should be appreciated that each expansion or filling of bladder 168 causes rotational movement of tube 174 and thereby moveable portion 54, the rotation of tube 174 and moveable portion 54 continues and repeats through three hundred and sixty degrees of rotation, and the embodiment depicted is only capable of unidirectional rotation. However, it is within the spirit and scope of the claimed invention to effect bidirectional rotational movement, and such arrangements may include modified ratchet mechanisms.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What is claimed is:

1. A valve apparatus for an inflatable article, wherein the inflatable article comprises a main body and a moveable portion, the valve comprising: a valve body comprising first and second chambers and first, second and third openings; and, a baffle moveable between first and second positions, wherein the moveable portion is inflatable and in fluid communication with the main body, the first chamber comprises the first and second openings, the first opening forms a first fluid communication between the main body and the first chamber, the second chamber comprises the second and third openings, the third opening forms a second fluid communication between the second chamber and an ambient atmosphere, movement of the moveable portion independently actuates the baffle between the first and second positions, when in the first position the baffle seals the first opening and when in the second position the baffle seals the third opening.

2. The valve apparatus of claim 1 wherein the baffle comprises a shaft having a first end and a second end opposite the first end, a first valve plate arranged adjacent to the first end and a second valve plate arranged adjacent to the second end.

3. The valve apparatus of claim 2 wherein the baffle further comprises a first secured plate fixedly secured to the shaft between the first end and the first valve plate and a second secured plate fixedly secured to the shaft between the second end and the second valve plate, the first secured plate comprises a first slot, the second secured plate comprises a second slot, the first valve plate comprises a first extension positioned within the first slot and the second valve plate comprises a second extension positioned within the second slot.

4. The valve apparatus of claim 1 further comprising a bellows secured to the valve body and in fluid communication with the second opening, wherein when the baffle is in the first position the bellows collapses and when the baffle is in the second position the bellows expands.

5. The valve apparatus of claim 4 wherein a single fluid moving apparatus inflates the main body and the bellows.

6. The valve apparatus of claim 1 wherein pivotal movement of the moveable portion independently actuates the baffle between first and second positions.

7. The valve apparatus of claim 1 wherein linear movement of the moveable portion independently actuates the baffle between first and second positions.

8. The valve apparatus of claim 1 wherein rotational movement of the moveable portion independently actuates the baffle between first and second positions.

9. An inflatable article comprising: a main body; a moveable portion; and a valve comprising: a valve body comprising first and second chambers and first, second and third openings; and, a baffle moveable between first and second positions, wherein the moveable portion is inflatable and in fluid communication with the main body, the first chamber comprises the first and second openings, the first opening forms a first fluid communication between the main body and the first chamber, the second chamber comprises the second and third openings, the third opening forms a second fluid communication between the second chamber and an ambient atmosphere, movement of the moveable portion independently actuates the baffle between the first and second positions, when in the first position the baffle seals the first opening and when in the second position the baffle seals the third opening.

10. The inflatable article of claim 9 wherein the baffle comprises a shaft having a first end and a second end opposite the first end, a first valve plate arranged adjacent to the first end and a second valve plate arranged adjacent to the second end.

11. The inflatable article of claim 10 wherein the baffle further comprises a first secured plate fixedly secured to the shaft between the first end and the first valve plate and a second secured plate fixedly secured to the shaft between the second end and the second valve plate, the first secured plate comprises a first slot, the second secured plate comprises a second slot, the first valve plate comprises a first extension positioned within the first slot and the second valve plate comprises a second extension positioned within the second slot.

12. The inflatable article of claim 9 further comprising a bellows secured to the valve body and in fluid communication with the second opening, wherein when the baffle is in the first position the bellows collapses and when the baffle is in the second position the bellows expands.

13. The inflatable article of claim 12 further comprising a single fluid moving apparatus, wherein the single fluid moving apparatus inflates the main body and the bellows.

14. The inflatable article of claim 9 wherein pivotal movement of the moveable portion independently actuates the baffle between first and second positions.

15. The inflatable article of claim 9 wherein linear movement of the moveable portion independently actuates the baffle between first and second positions.

16. The inflatable article of claim 9 wherein rotational movement of the moveable portion independently actuates the baffle between first and second positions.

17. A method of affecting animation in an inflatable article comprises a main body, a moveable portion and a valve comprising a valve body and a baffle, the moveable portion is inflatable and in fluid communication with the main body, the valve body comprising first and second chambers and first, second and third openings, the baffle moveable between first and second positions, the first chamber comprises the first and second openings, the first opening forms a first fluid communication between the main body and the first chamber, the second chamber comprises the second and third openings, the third opening forms a second fluid communication between the second chamber and an ambient atmosphere, when in the first position the baffle seals the first opening and when in the second position the baffle seals the third opening, the method comprising the steps of: a) providing a positive air pressure within the main body via at least one fluid moving apparatus; b) expanding a bladder arranged between the main body and the moveable portion via the positive air pressure and the first fluid communication from the main body, through the first chamber and to the bladder, wherein the bladder imparts a force on a moveable plate attached to the moveable portion; c) animating the moveable portion relative to the inflatable article via the force on the moveable plate; d) changing the position of the baffle from the second position to the first position via an operable connection formed between the moveable plate and the baffle, wherein animating the moveable portion independently changes the baffle between the second and first positions; and, e) collapsing the bladder by exhausting the positive air pressure from the bladder, through the second chamber and to the ambient atmosphere via the second fluid communication.

* * * * *